US009061316B2

(12) United States Patent
Jeter

(10) Patent No.: US 9,061,316 B2
(45) Date of Patent: Jun. 23, 2015

(54) MOUNTABLE DEVICE FOR DISPENSING HEATED ADHESIVE

(71) Applicant: Nordson Corporation, Westlake, OH (US)

(72) Inventor: David R. Jeter, Woodstock, GA (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 13/659,291

(22) Filed: Oct. 24, 2012

(65) Prior Publication Data

US 2013/0105516 A1 May 2, 2013

Related U.S. Application Data

(60) Provisional application No. 61/552,961, filed on Oct. 28, 2011.

(51) Int. Cl.
*B05C 11/10* (2006.01)

(52) U.S. Cl.
CPC ..... *B05C 11/1047* (2013.01); *B05C 11/1042* (2013.01)

(58) Field of Classification Search
CPC ..... B05C 5/001; B05C 11/1034
USPC ..... 222/146.5, 183, 167–168; 248/125.1, 248/200, 274.1, 291.1, 292.11
See application file for complete search history.

(56) References Cited

U.S. PATENT DOCUMENTS 3,531,023 A * 9/1970 Mercer ..... 222/146.5
4,724,983 A * 2/1988 Claassen ..... 219/421
4,848,420 A * 7/1989 Claassen ..... 141/82
4,907,629 A * 3/1990 Claassen ..... 141/82
4,919,308 A * 4/1990 Majkrzak ..... 222/146.5
4,986,501 A * 1/1991 Simon ..... 248/122.1
5,201,822 A * 4/1993 Chen ..... 194/350
5,407,101 A * 4/1995 Hubbard ..... 222/146.5
5,561,886 A * 10/1996 Flamme ..... 16/265
5,568,362 A * 10/1996 Hansson ..... 361/736

(Continued)

FOREIGN PATENT DOCUMENTS

EP 0072679 A1 2/1983
EP 2119509 A2 11/2009

(Continued)

OTHER PUBLICATIONS

European Patent Office, International Search Report and Written Opinion in PCT Serial No. PCT/2012/061899, Apr. 10, 2013.

(Continued)

*Primary Examiner* — Kevin P Shaver
*Assistant Examiner* — Michael J Melaragno
(74) *Attorney, Agent, or Firm* — Wood, Herron & Evans, LLP

(57) ABSTRACT

A device for dispensing a heated liquid, such as a hot melt adhesive, includes a vertically oriented mounting plate; a melter subassembly including an adhesive manifold, a heater, and a pump adapted to dispense the heated liquid; a control subassembly adapted to control one or more components of the melter subassembly; and a subassembly cover coupled to the mounting plate for movement between an open condition and a closed condition. The subassembly cover thermally insulates the melter assembly from the control assembly when in the closed condition.

28 Claims, 8 Drawing Sheets

(56) References Cited

U.S. PATENT DOCUMENTS

| | | | | |
|---|---|---|---|---|
| 5,680,961 | A * | 10/1997 | Boccagno et al. | 222/143 |
| 5,940,937 | A * | 8/1999 | Churchill et al. | 16/382 |
| 6,467,640 | B1 * | 10/2002 | Hung | 220/4.02 |
| 6,755,493 | B1 * | 6/2004 | Krietzman et al. | 312/248 |
| 7,626,143 | B2 | 12/2009 | Miller | |
| 7,815,065 | B2 * | 10/2010 | Gosche | 220/4.02 |
| 7,952,023 | B2 * | 5/2011 | Caveney et al. | 174/68.1 |
| 8,091,969 | B2 * | 1/2012 | Caveney et al. | 312/248 |
| 8,115,098 | B2 * | 2/2012 | Jones et al. | 174/50 |
| 2005/0098579 | A1 * | 5/2005 | Dittmann et al. | 222/146.5 |
| 2005/0127096 | A1 * | 6/2005 | Cole et al. | 222/108 |
| 2006/0118576 | A1 * | 6/2006 | Jeter | 222/146.5 |
| 2012/0061541 | A1 * | 3/2012 | Huang et al. | 248/274.1 |
| 2013/0105003 | A1 | 5/2013 | Quam et al. | |
| 2013/0105004 | A1 | 5/2013 | Tix et al. | |
| 2013/0105005 | A1 | 5/2013 | Tix et al. | |
| 2013/0105039 | A1 | 5/2013 | Tix et al. | |
| 2013/0105517 | A1 | 5/2013 | Tix et al. | |
| 2013/0105526 | A1 | 5/2013 | Ross et al. | |
| 2013/0112279 | A1 | 5/2013 | Ross et al. | |
| 2013/0112280 | A1 | 5/2013 | Quam et al. | |
| 2013/0112294 | A1 | 5/2013 | Ross et al. | |
| 2013/0112312 | A1 | 5/2013 | Ross et al. | |
| 2013/0112709 | A1 | 5/2013 | Ross et al. | |
| 2013/0112710 | A1 | 5/2013 | Ross et al. | |
| 2013/0112711 | A1 | 5/2013 | Lind et al. | |
| 2013/0115016 | A1 | 5/2013 | Ross et al. | |

FOREIGN PATENT DOCUMENTS

| | | | |
|---|---|---|---|
| GB | 1562562 | A | 3/1980 |
| WO | 2007084891 | A2 | 7/2007 |

OTHER PUBLICATIONS

Meltex Corporation; Product Information Sheet; Hot Melt Applicator MP 400; 1 page.

Meltex GmbH; Product Information Sheet; Hot Melt Applicator MX 2001; 2 pages.

Meltex GmbH; Product Information Sheet; Hot Melt Applicator MX 2003; 2 pages.

European Patent Office; International Preliminary Report on Patentability in International Patent Application No. PCT/US2012/061899 dated Apr. 29, 2014; 6 pages.

* cited by examiner

MOUNTABLE DEVICE FOR DISPENSING HEATED ADHESIVE

CROSS REFERENCE

This application claims priority under 35 U.S.C. §119(e) to U.S. Provisional Patent Application Ser. No. 61/552,961, filed on Oct. 28, 2011 (pending), the disclosure of which is incorporated by reference herein in its entirety.

TECHNICAL FIELD

The present invention generally relates to liquid dispensing devices used for a variety of purposes, and more particularly to dispensing devices for heated adhesives.

BACKGROUND

A conventional dispensing device for supplying heated adhesive (i.e., a hot-melt adhesive dispenser) generally includes an inlet for receiving adhesive materials, a heated grid in communication with the inlet which heats the adhesive materials, an outlet in communication with the heated grid, which receives the heated adhesive from the heated grid, a hose connected to the outlet for directing the dispensation of the heated adhesive, and a pump in communication with the heated grid and outlet for driving and controlling the dispensation of the heated adhesive through the outlet. Furthermore, conventional dispensing devices generally includes a controller (e.g., a processor and a memory), input controls electrically connected to the controller to facilitate user interface with the dispensing device, and the controller is in communication with the pump, heated grid, and/or other components of the device, such that the controller controls the dispensation of the heated adhesive.

Conventional hot-melt adhesive dispensers typically operate at elevated temperatures, such as about 350° F. The high temperatures are generally required to sufficiently heat received adhesive materials prior to dispensing the heated adhesive. Various measures are typically taken to insulate a hot-melt adhesive dispenser to make the dispenser more efficient at heating the adhesive and also in consideration of operator safety.

Conventional hot-melt dispensers also generally have a large footprint (i.e., occupied space), and conventional dispensers typically rest on horizontal surfaces (i.e., a floor or table) in a workspace utilizing valuable workspace. In addition, while insulating the hot-melt adhesive dispenser is desirable with regard to thermal efficiency, the resulting temperatures within the housing of the dispenser may lead to reliability issues of various components of the dispenser.

For reasons such as these, an improved hot-melt adhesive dispenser design would be desirable.

SUMMARY

In accordance with one aspect, a device for dispensing adhesive may include a vertically oriented mounting plate having front and back sides. The dispenser also includes a melter subassembly including an adhesive manifold, a heated grid (i.e., a heater), and a pump coupled to the mounting plate. In some embodiments, a lift-off hinge removably and rotatably couples the melter subassembly to the mounting plate. The melter subassembly may also include an inlet for receiving adhesive material, and an outlet for dispensing heated adhesive material, and the melter subassembly heats adhesive material received from the inlet and controllably dispenses heated adhesive material through the outlet.

In a second aspect, a dispenser may include a control subassembly coupled to the mounting plate and spaced apart from the melter subassembly. The control subassembly includes a controller (e.g., an integrated circuit, a processor, a memory) where the control subassembly is in communication with one or more components of the melter subassembly such that the control subassembly communicates with the one or more components of the melter subassembly to thereby control operation of the one or more components of the melter subassembly.

In addition, the dispenser may include a subassembly cover coupled to the mounting plate. The subassembly cover may be moved between an open condition and a closed condition, such that in the closed condition the subassembly cover covers the melter subassembly, and may further cover the control subassembly. In the closed condition, the subassembly cover thermally insulates the melter subassembly from the control subassembly. When in the open condition, the melter subassembly and/or the control subassembly are exposed for access by a user of the device. Hence, when in the closed condition, the subassembly cover reduces heat transfer between the melter subassembly and the control subassembly. Thermally insulating the melter subassembly from the control subassembly may extend the life of the control subassembly, allow the melter subassembly to operate at higher temperatures, and/or give rise to other such advantages.

In some embodiments, the subassembly cover may comprise one or more additional portions, where if two or more portions are included, the portions may be coupled to the mounting plate at different positions. In addition, in an aspect of some embodiments, the subassembly cover may include one or more insulation elements mounted to the subassembly cover, and/or one or more thermal vents passing through one or more surfaces of the subassembly cover.

Advantages over conventional hot-melt adhesive dispensers may be realized in dispensers consistent with the invention. For example, a smaller foot-print as compared to conventional dispensers may be realized. Advantageously, embodiments of the invention may be mounted to a vertical plane, which may thereby improve integration with workspaces utilizing hot-melt adhesive dispensers. In addition, the control subassembly and melter subassembly of embodiments of the invention may be spaced apart and thereby reducing heat transfer between the control subassembly and the melter subassembly. As a result of the relatively smaller volume of a dispenser in accordance with the principles of the present invention, faster warm-up times from a cold start are possible. Moreover, dispenser embodiments that do not have a tank facilitate reduced adhesive dwell times, thereby eliminating or minimizing heat degradation of the adhesive.

Various additional features and advantages of the invention will become more readily apparent to those of ordinary skill in the art upon review of the following detailed description of the illustrative embodiments, taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description below, serve to explain one or more embodiments of the invention.

It should be understood that the appended drawings may not necessarily be to scale, presenting a somewhat simplified representation of various preferred features illustrative of the basic principles of embodiments of the invention. The specific features consistent with embodiments of the invention disclosed herein, including, for example, specific dimensions, orientations, locations, sequences of operations and shapes of various illustrated components, will be determined in part by the particular intended application, use and/or environment. Certain features of the illustrated embodiments may have been enlarged or distorted relative to others to facilitate visualization and clear understanding.

DETAILED DESCRIPTION

Figure 1:
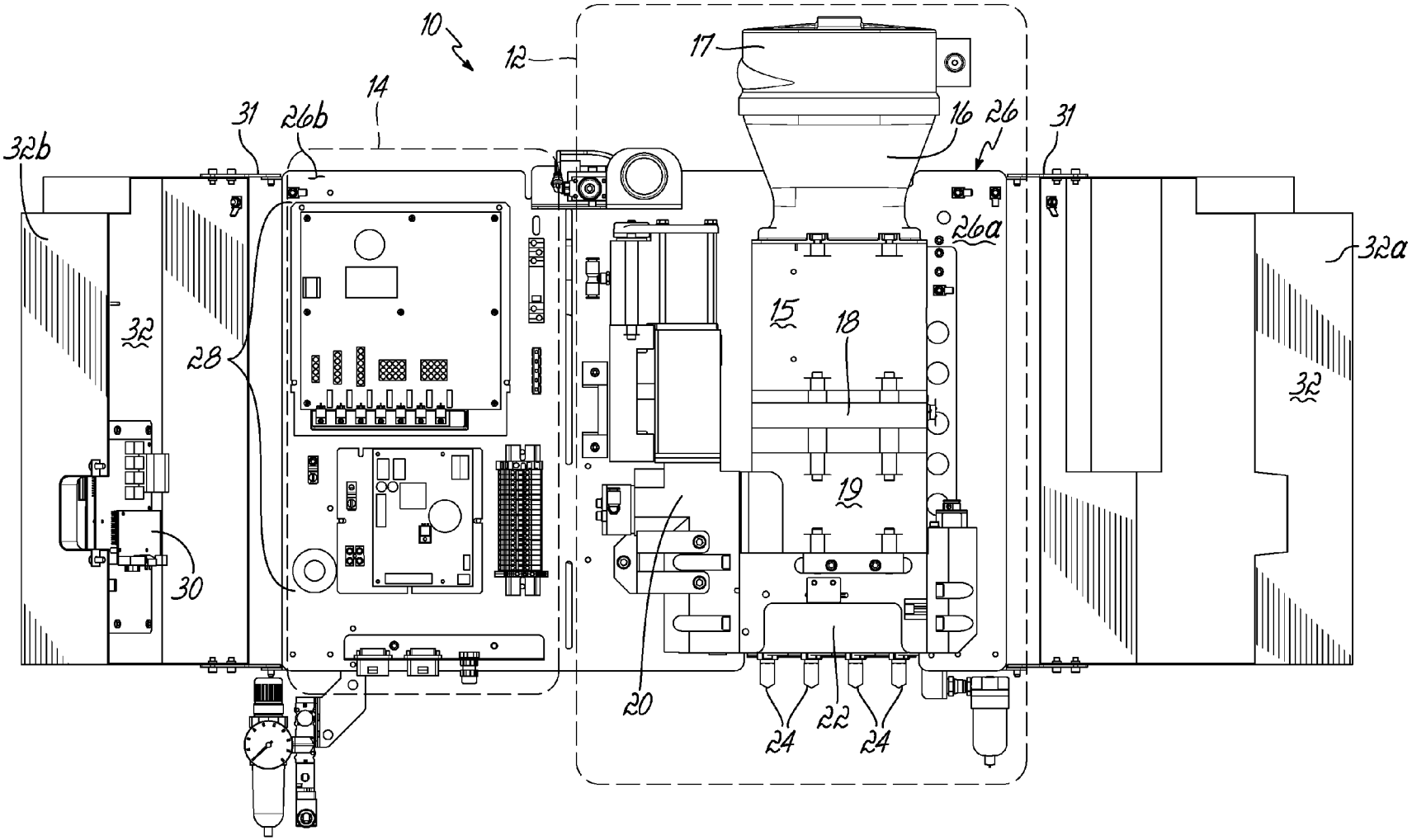
FIG. 1 is a front elevation view of an exemplary embodiment of a device for dispensing a heated liquid in accordance with the principles of the present disclosure.

With reference to FIG. 1, an embodiment of a dispenser 10 for dispensing a heated liquid (i.e., a dispenser), such as a hot melt adhesive, is illustrated. The dispenser 10 includes a melter subassembly 12 and a control subassembly 14. The melter subassembly 12 generally includes an inlet 16 for receiving adhesive material (not shown). The melter subassembly 12 also includes a heated grid (i.e., a heater) 18 in communication with the inlet 16 and configured to heat adhesive received from the inlet 16 via a hopper 15 or other suitable conduit. Hopper 15 may include a sensor 13, such as a capacitive sensor, for sensing a level of adhesive material inside hopper 15. Signals from sensor 13 may be communicated to a controller 28 (discussed below) when dispenser 10 is configured for automatic feeding of adhesive to inlet 16, whereby the controller 28 can control the feed of adhesive to the dispenser 10. While sensor 13 is described herein as a capacitive sensor, it will be appreciated that various other types of sensors suitable for sensing a level of adhesive material in hopper 15 may alternatively be used.

The hopper 15 is smaller than the hoppers of conventional melters. The heated grid 18 is sized or matched to the pellet size of hotmelt adhesive. By utilizing a small hopper 15 and rapidly heating the adhesive with the heated grid 18, the throughput of adhesive may approximate that of much larger sized melters.

A cyclone 17 is in communication with the inlet 16, such that adhesive materials may be loaded into the cyclone 17, and the cyclone 17 facilitates feeding adhesive materials into the inlet 16. While cyclone 17 is provided herein for feeding adhesive materials into inlet 16, it will be appreciated that various other structure could alternatively be used to feed adhesive materials into inlet 16, including structure for feeding a supply of adhesive materials into an inlet such as a tank, a tube, a pressurized hose, and/or a funnel, for example. A heated adhesive reservoir 19 in communication with the heated grid 18 holds heated adhesive received from the heated grid 18 for dispensing. A pump 20 and a manifold 22 in communication with the reservoir 19 and outlet(s) 24 controllably dispense heated adhesive from the reservoir 19 through the outlet 24. The pump 20 may be a piston pump, and may be mounted vertically or parallel to the centerline of the hopper 15 and heated grid 18. Melter subassembly 12 may be coupled to a vertically oriented mounting plate 26, which will be described in more detail below.

The control subassembly 14 is coupled to the mounting plate 26 adjacent the melter subassembly 12, such that the melter subassembly 12 and control subassembly 14 are spaced apart. In some embodiments, the melter assembly 12 is proximate a first terminal end **26*a* of the mounting plate 26 and the control subassembly 14 is proximate a second terminal end 26*b* of the mounting plate 26. The control subassembly 14 is in communication with the melter subassembly 12 to thereby communicate and control one or more components of the melter subassembly 12, including the heated grid 18 and/or the pump 20. The control subassembly 14 generally includes a controller (e.g., one or more integrated circuits) 28 operatively connected to a control interface 30, such that a user of the dispenser 10 may interface with the dispenser 10 via the control interface 30, and the controller 28 may receive input data from the control interface 30 to thereby control the operation of the dispenser 10 and the melter subassembly 12**.

Figure 2:
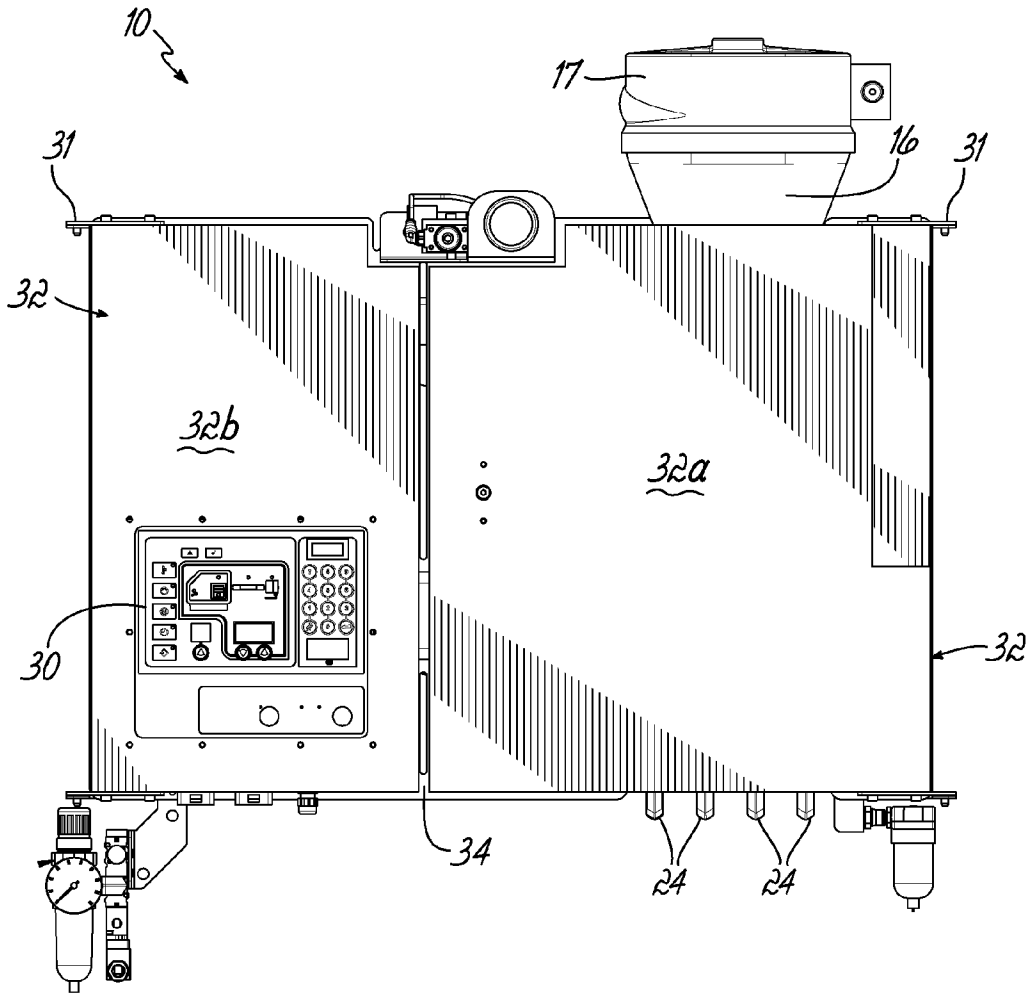
FIG. 2 is a front elevation view of the device of FIG. 1, where a subassembly cover of the dispenser of FIG. 1 is in a closed condition.
Figure 3:
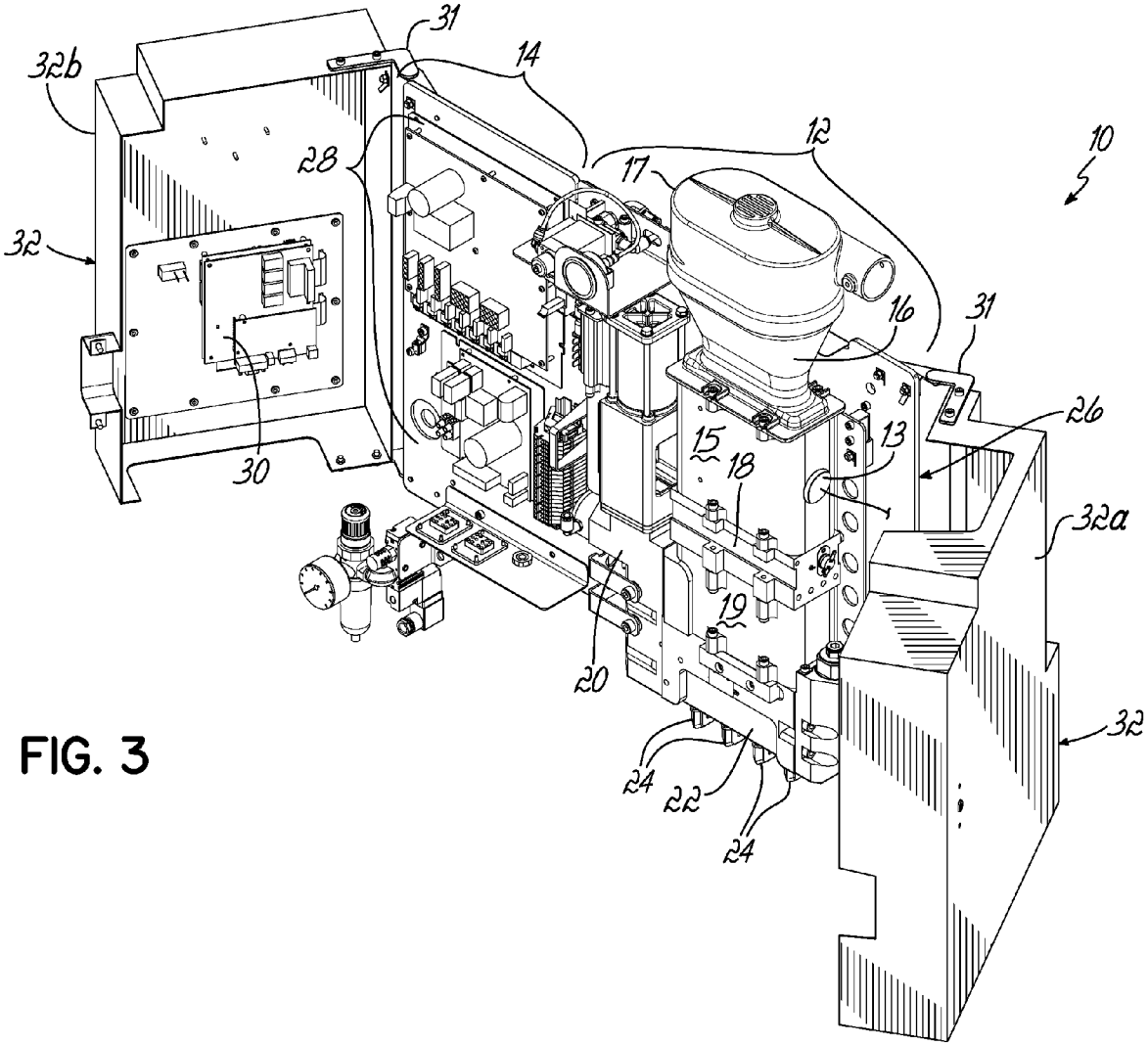
FIG. 3 is a perspective view of the device of FIG. 1, with the subassembly cover of the dispenser of FIG. 1 is in an opened condition.

With continued reference to FIG. 1, and referring further to FIGS. 2 and 3, a subassembly cover 32 is coupled to the mounting plate 26. The subassembly cover 32 insulates the melter subassembly 12 from the control subassembly 14 when in a closed condition (FIG. 2), and facilitates access to the melter subassembly 12 and/or the control subassembly 14 when in an open condition (FIGS. 1 and 3). In some embodiments, the subassembly cover 32 may be removably and/or hingedly coupled to the mounting plate 26. As shown in FIG. 1, the subassembly cover 32 includes a first section **32*a* hingedly coupled to the mounting plate 26 proximate the melter subassembly 12 and/or the first terminal end 26*a* such as by hinge assemblies 31, such that the first section 32*a* and the mounting plate 26 substantially enclose the melter subassembly 12 when the first section 32*a* is in a closed position. Similarly, the subassembly cover 32 includes a second section 32*b* hingedly coupled to the mounting plate 26 proximate the control subassembly 14 and/or the second terminal end 26*b* such as by hinge assemblies 31, such that the second section 32*b* and the mounting plate 26 substantially enclose the control subassembly 14 when in the second section 32*b*** is in a closed condition.

FIG. 2 illustrates the dispenser 10 of FIG. 1, where the first section **32*a* of the subassembly cover 32 and the second section 32*b* of the subassembly cover 32 are in the closed condition. Control interface 30 may be coupled to the subassembly cover 32, such that a user of the dispenser 10 may control the dispenser 10 via the control interface 30. In addition, as shown in FIG. 2, the first section 32***a* and second section 32*b* of the subassembly cover 32 define a thermal gap 34 when in the closed condition. Similarly, FIG. 3 illustrates the device of FIG. 1, where the first section 32*a* of the subassembly cover 32 and the second section 32*b* of the subassembly cover are in the open condition, such that the melter subassembly 12 and control subassembly 14 may be accessible to a user for maintenance and/or repair.

Figure 4:
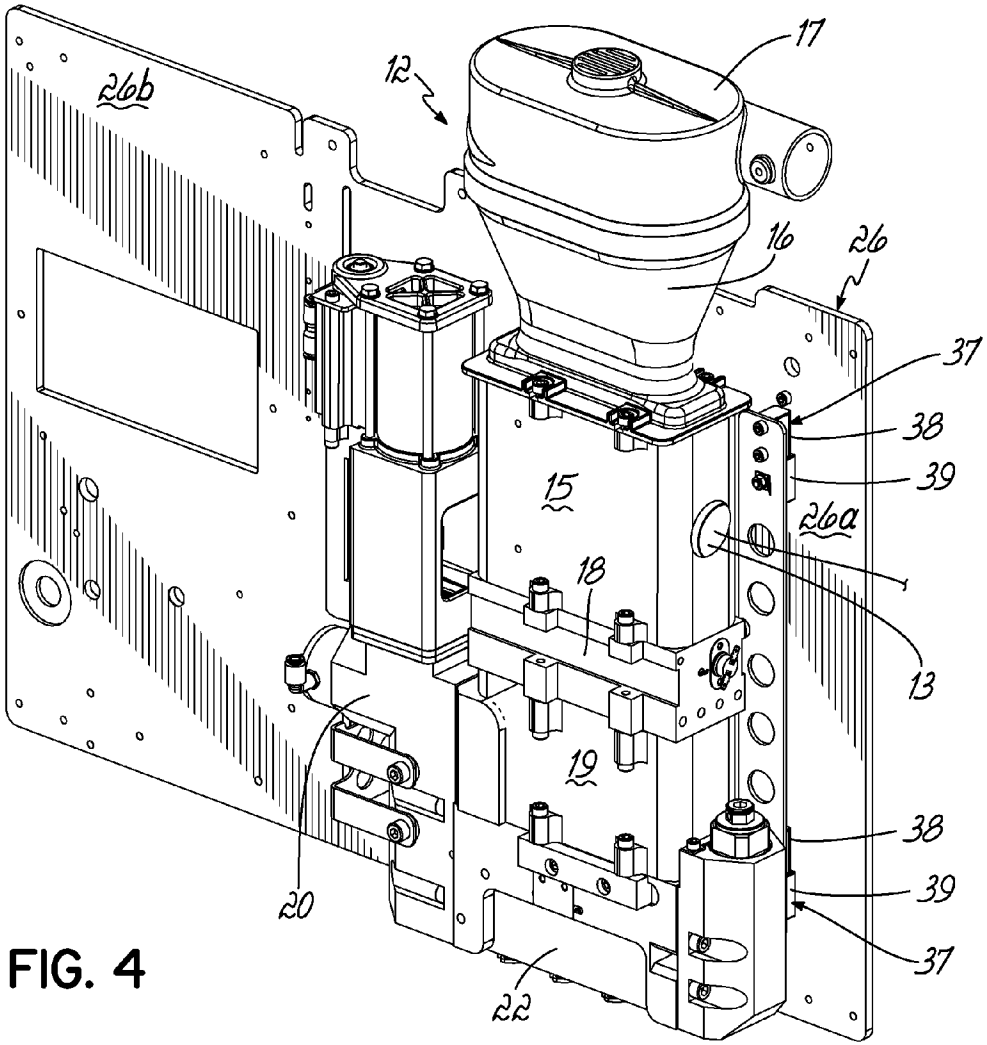
FIG. 4 is an enlarged perspective view of a melter subassembly and mounting plate of the dispenser of FIG. 1.
Figure 5:
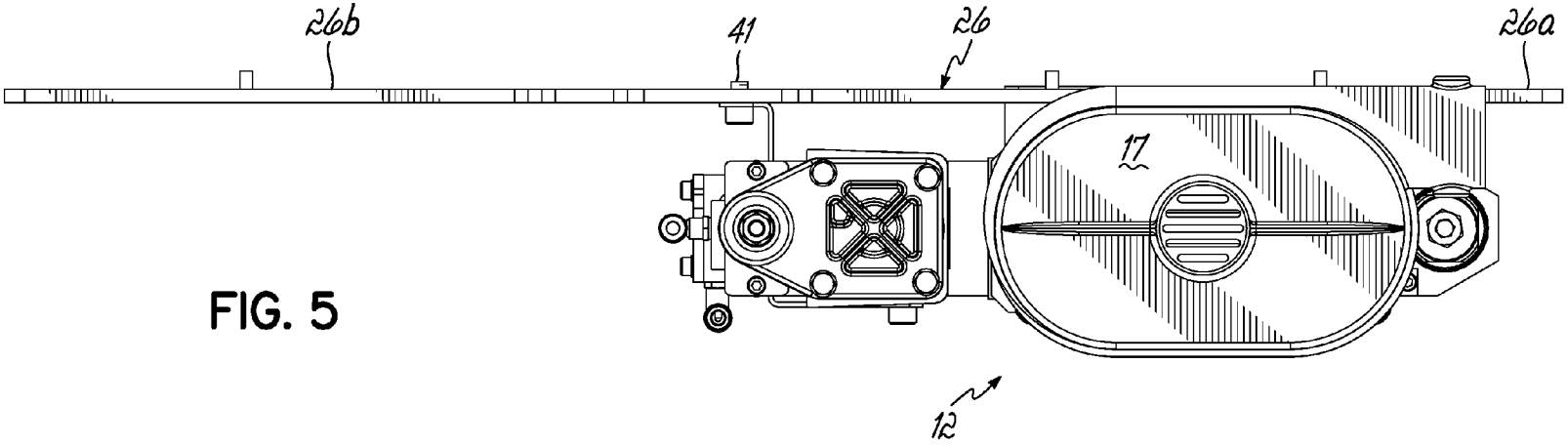
FIG. 5 is a top view of the melter subassembly and mounting plate of the dispenser of FIG. 1 with the melter subassembly adjacent the mounting plate.
Figure 6:
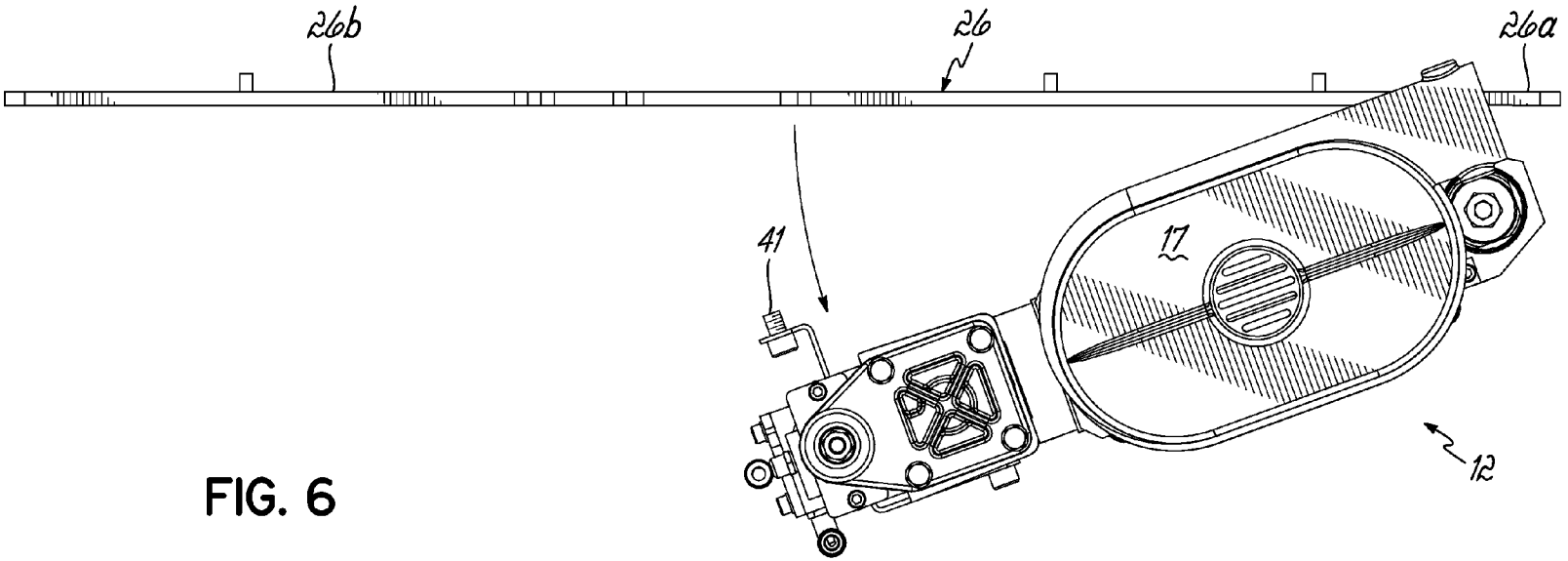
FIG. 6 is a top view of the melter subassembly and mounting plate of the dispenser of FIG. 1 with the melter subassembly rotated away from the mounting plate.

FIG. 4 is an exemplary embodiment of the melter subassembly 12 of FIG. 1 coupled to the mounting plate 26. As shown in FIG. 4, in some embodiments, the melter subassembly is coupled to the mounting plate 26 via lift-off hinges 37. Lift-off hinges 37 include a first portion 39 fixed to mounting plate 26, and a second portion 38 removably hingedly coupled to melter subassembly 12. In the embodiment shown, melter subassembly 12 is coupled to mounting plate 26 by lift-off hinges, such as removable lift-off hinge Part No. 96-50-500-50, available from Southco, Inc., Concordville, Pa. It will be appreciated that various other structures may alternatively be used to removably and/or hingedly couple melter subassembly 12 to mounting plate 26. Accordingly, as illustrated in FIGS. 5 and 6, which provides alternative views of FIG. 4, in some embodiments, the melter subassembly 12 may be rotatably coupled to the mounting plate 26, such that in a first position the melter subassembly 12 may be adjacent the mounting plate 26 (FIG. 5), and in a second position, the melter assembly 12 may be pivoted away from the mounting plate (FIG. 6). In these embodiments, the rotation of the melter assembly 12 relative to the mounting plate 26 may facilitate access to one or more components of the melter subassembly 12. As shown in FIGS. 5 and 6, the melter subassembly 12 may include a latch 41 (shown here as a screw fastener), wherein the latch 41 may secure the melter subassembly 12 to the mounting plate when the melter assembly is in the first position (FIG. 5) adjacent the mounting plate 26. As shown in FIG. 6, the melter subassembly 12 may be pivoted relative to the mounting plate 26, and in some embodiments, the latch 41 may be unsecured from the mounting plate 26 to permit pivoting of the melter subassembly 12 relative to the mounting plate 26. In some embodiments, the melter subassembly 12 may also be removably coupled to the mounting plate 26 such that the melter subassembly 12 may be removed from dispenser 10 such as for replacement, maintenance, and/or repair.

Figure 7:
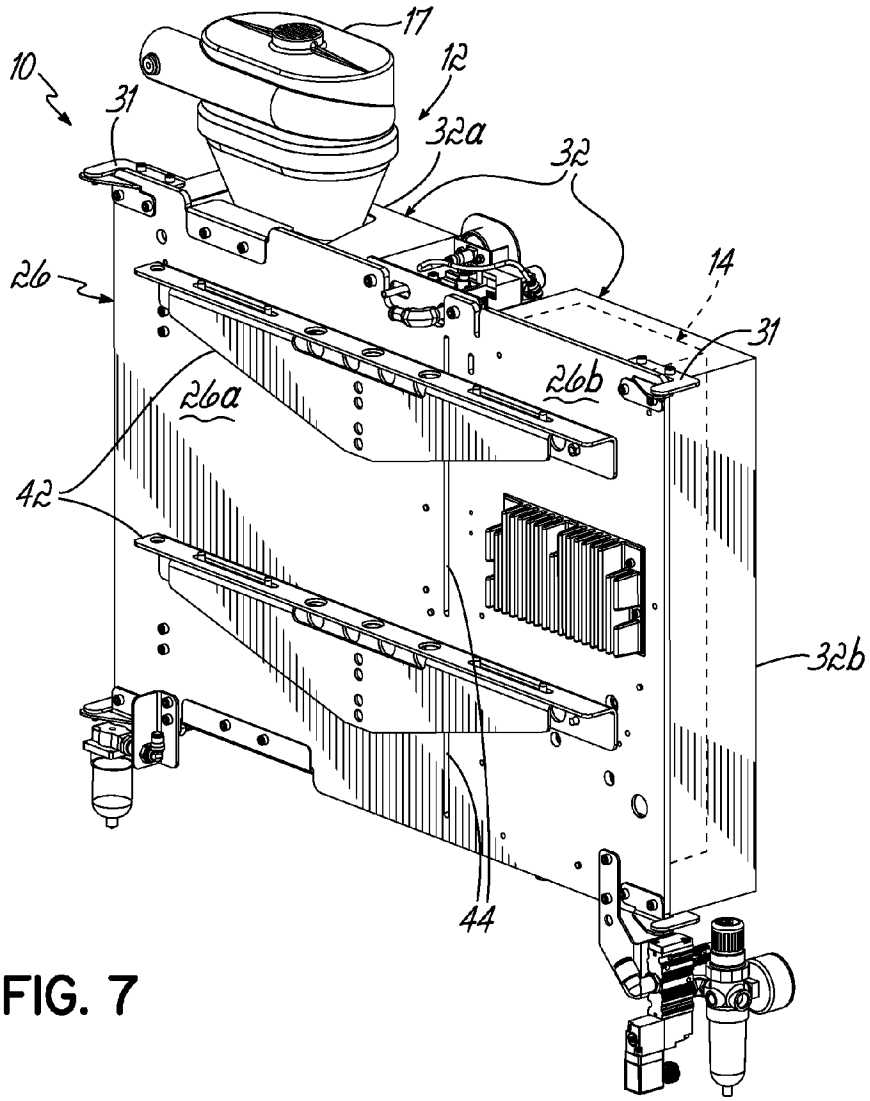
FIG. 7 is a rear perspective view of the dispenser of FIG. 2.

Referring now to FIG. 7, in some embodiments, one or more mounting brackets 42 may be coupled to the mounting plate 26, to facilitate mounting the dispenser 10 to a vertical surface. In addition, as shown in FIG. 7, the mounting plate 26 may include one or more thermal vents 44 passing through the mounting plate 26. The thermal vents 44 may be positioned on mounting plate 26 between the melter subassembly 12 and the control subassembly 14, such as a location corresponding to thermal gap 34, so that the one or more thermal vents 44 may reduce heat transfer between the melter subassembly 12 and the control subassembly 14.

Figure 8:
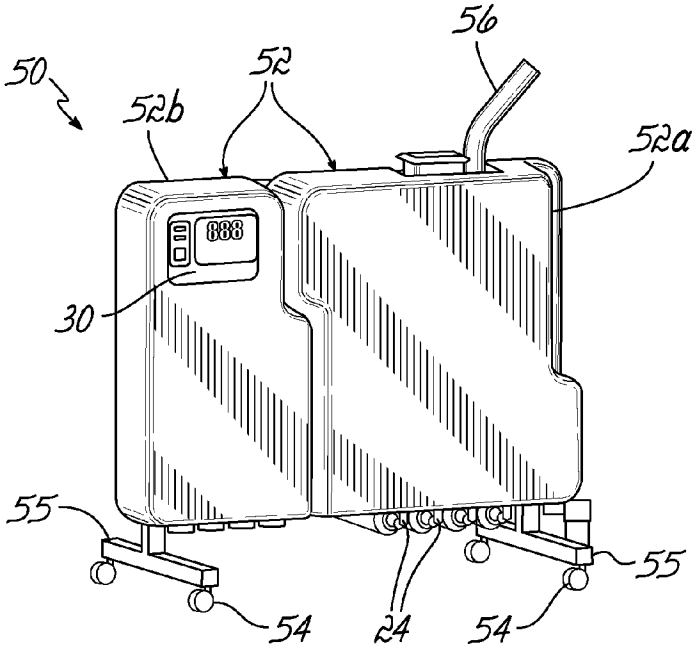
FIG. 8 is a front perspective view of a second exemplary embodiment of a dispenser in accordance with the principles of the present disclosure.

FIG. 8 depicts another exemplary embodiment of a hot melt adhesive dispenser 50, in accordance with the principles of the invention. As shown in FIG. 8, dispenser 50 includes a subassembly cover 52 including a first section 52*a* and a second section 52*b*. The dispenser 50 may also include a plurality of rolling elements 54 coupled to the dispenser 50, such that the rolling elements 54 facilitate rolling movement of the dispenser 50 on a floor surface. Rolling elements 54 may be coupled to the dispenser 50 by a stand 55. While rolling elements 54 is shown herein as including caster-like components, it will be appreciated that various other structure may alternatively be used to facilitate movement of the dispenser 50 on a floor surface, including friction reducing elements such as wheels, low-friction pads, for example. The dispenser 50 may also include a tube 56 for feeding adhesive material into an inlet (not shown) of the dispenser 50.

Figure 9:
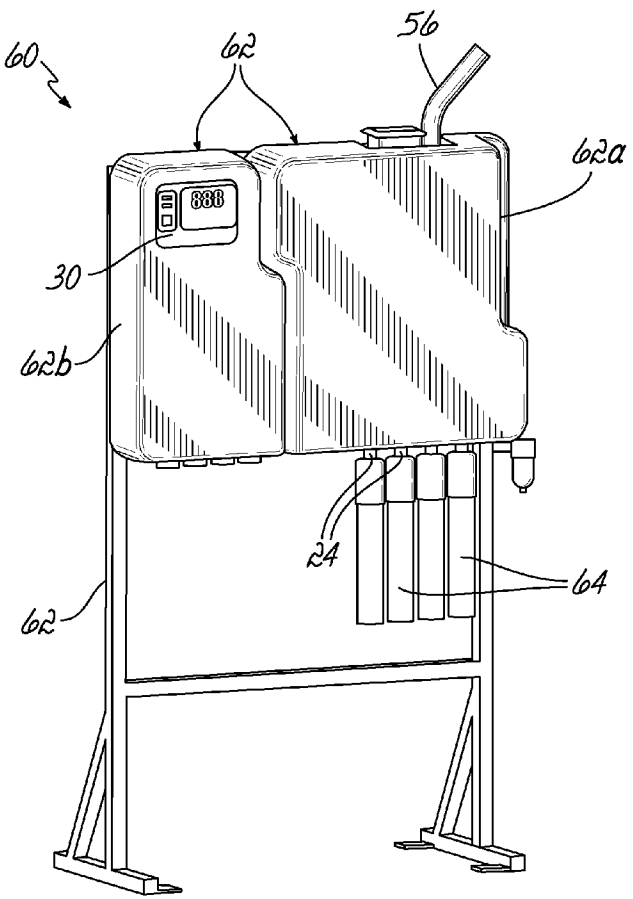
FIG. 9 is a front perspective view of a third exemplary embodiment a dispenser in accordance with the principles of the present disclosure.

FIG. 9 depicts another exemplary embodiment of a hot melt adhesive dispenser 60, in accordance with principles of the invention. As shown in FIG. 9, dispenser 60 is coupled to a vertical surface of a stand 62, where stand 62 may be configured to support dispenser 60 above a horizontal surface. Dispenser 60 may include a mounting plate and bracket such as those described above with respect to FIG. 7 for coupling the dispenser 60 to the stand 62. FIG. 9 also depicts dispensing hoses 64 rotatably coupled to outlets 24.

Figure 10:
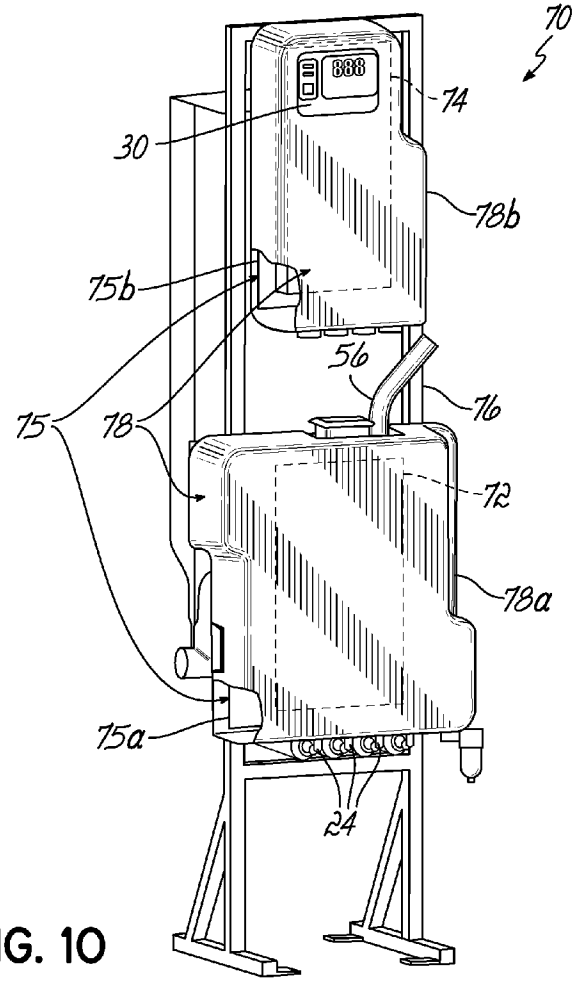
FIG. 10 is a front perspective view of a fourth exemplary embodiment of a dispenser in accordance with the principles of the present disclosure.

FIG. 10 depicts another exemplary embodiment of a hot melt adhesive dispenser 70 in accordance with principles of the present invention. As shown in FIG. 10, dispenser 70 includes a melter subassembly 72 and a control subassembly 74 coupled to a vertical surface of a stand 76. As a non-limiting example, melter subassembly 72 and control subassembly 74 may be coupled to the stand 76 by a mounting plate 75 and brackets similar to brackets 42 as described above with respect to FIG. 7. It will be appreciated, however, that various other structure and methods may alternatively be used to couple melter subassembly 72 and control subassembly 74 to stand 76. As shown in this embodiment, the melter subassembly 72 and the control subassembly 74 are spaced apart along a generally vertical direction. The mounting plate may comprise a first mounting plate section 75*a* coupled to the melter subassembly 72 and a second mounting plate section 75*b* coupled to the control subassembly 74. In addition, as shown, a subassembly cover 78 may include a first section 78*a* configured to enclose the melter subassembly 72 when in a closed condition, and a second section 78*b* configured to enclose the control subassembly 74 when in a closed condition.

Figure 11:
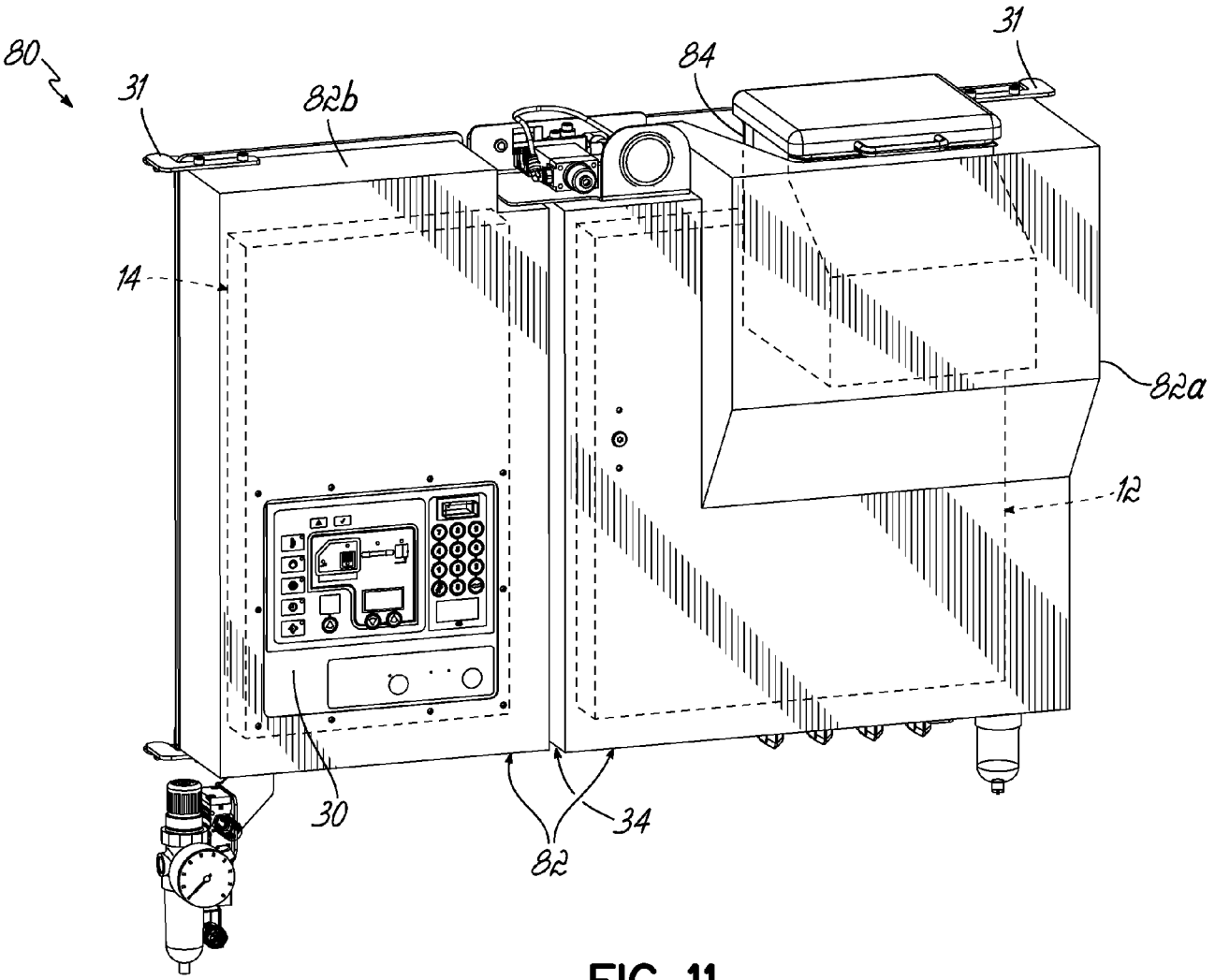
FIG. 11 is a front perspective view of a fifth exemplary embodiment of a dispenser in accordance with the principles of the present disclosure.

FIG. 11 depicts another exemplary embodiment of a hot melt adhesive dispenser 80. As shown, dispenser 80 includes a subassembly cover 82 including a first section 82*a* and a second section 82*b*, where the first section 82*a* is configured to enclose a melter subassembly 12 when in a closed condition, and the second section 82*b* is configured to enclose a control subassembly 14 when in a closed condition. As shown in FIG. 11, the first section 82*a* is configured to enclose the melter subassembly 12, where the melter subassembly includes an enlarged tank 84 in communication with an inlet (not shown) of the dispenser 80, such that a reserve of adhesive material may be retained in the tank and controllably dispensed via the inlet to a heated grid of the melter subassembly.

According to principles of the present invention, a hot melt adhesive dispenser is provided. Advantageously, the dispenser may include a vertically oriented mounting plate coupled to a melter subassembly and a control subassembly such that the dispenser may be mounted on a vertical surface and/or casters. Moreover, the dispenser may include a subassembly cover configured to substantially thermally isolate the melter subassembly and the control subassembly and thereby reduce heat transfer between the melter subassembly and the control subassembly. As such, dispensers consistent with embodiments of the invention may overcome limitations of conventional systems which typically include large device footprints due to the integrated nature of the components of the conventional systems. Moreover, dispensers according to principles of the invention may improve reliability of electrical components included in the control subassembly by, for example, reducing heat transfer from the melter subassembly to the control subassembly. Furthermore, a dispenser may include a melter subassembly rotatably and removably coupled to the mounting plate, such that the melter subassembly may be rotated relative to the mounting plate to facilitate access to components of the melter subassembly, such that the melter subassembly may be removed from the device for repair, maintenance, and/or repair.

While the invention has been illustrated by a description of various embodiments and examples, and while these embodiments have been described in considerable detail, it is not the intention of the applicants to restrict or in any other way limit the scope of the appended claims to such detail. The various features shown and described herein may be used alone or in any combination. Additional advantages and modifications will readily appear to those skilled in the art. Thus, the invention in its broader aspects is therefore not limited to the specific details, representative apparatus and method, and illustrative example shown and described. Accordingly, departures may be made from such details without departing from the spirit or scope of applicants' general inventive concept.

What is claimed is:

1. An apparatus for dispensing adhesive, comprising:

a vertically oriented mounting plate having front and back sides;

a melter subassembly including an adhesive manifold, a heater, and a pump, the melter subassembly removably coupled to the front side of the mounting plate and configured to controllably dispense a heated adhesive;

a control subassembly coupled to the front side of the mounting plate and spaced apart from the melter subassembly;

the control subassembly including a controller in communication with the melter subassembly; and a subassembly cover coupled to the mounting plate for movement between an open condition and a closed condition, the subassembly cover thermally insulating the melter subassembly from the control subassembly when in the closed condition.

2. The apparatus of claim 1, wherein the subassembly cover is removably coupled to the mounting plate.

3. The apparatus of claim 1, wherein the subassembly cover is hingedly coupled to the mounting plate for movement between the open and closed conditions.

4. The apparatus of claim 1, wherein the melter subassembly is removably hingedly coupled to the mounting plate for movement between a first position adjacent the mounting plate and a second position pivoted away from the mounting plate to facilitate access to both sides of the melter subassembly.

5. The apparatus of claim 4, further comprising a latch for securing the melter subassembly in the first position.

6. The apparatus of claim 1, wherein the mounting plate includes first and second terminal ends, and wherein the melter subassembly is coupled to the mounting plate proximate the first terminal end, and the control subassembly is coupled to the mounting plate proximate the second terminal end.

7. The apparatus of claim 1, wherein the melter subassembly includes an outlet, the apparatus further comprising a dispensing hose rotatably coupled to said outlet.

8. The apparatus of claim 1, further comprising at least one mounting bracket coupled to the mounting plate and facilitating mounting the apparatus on a vertical surface.

9. The apparatus of claim 1, further comprising a plurality of rolling elements operatively coupled to the apparatus and facilitating rolling movement of the apparatus on a floor surface.

10. The apparatus of claim 1, wherein the subassembly cover includes at least a first section hingedly coupled to the mounting plate, the first section enclosing the melter subassembly in the closed condition.

11. The apparatus of claim 10, wherein said subassembly cover includes a second section hingedly coupled to the mounting plate, the second section enclosing the control subassembly in the closed condition.

12. The apparatus of claim 11, wherein when the subassembly cover first section and the subassembly cover second section are in the closed condition, the first section and second section are spaced apart to define a thermal gap between the melter subassembly and the control subassembly.

13. The apparatus of claim 1, further comprising a lift-off hinge coupling the mounting plate and the melter subassembly, wherein the mounting plate and melter subassembly are removably and rotatably coupled by the lift-off hinge.

14. The apparatus of claim 1, further comprising a stand having a vertical surface, and wherein the mounting plate is coupled to the vertical surface of the stand.

15. An apparatus for dispensing adhesive, comprising:

a vertically oriented mounting plate having front and back sides;

a melter subassembly including an adhesive manifold, a heater, and a pump;

the melter subassembly pivotally coupled to the front side of the mounting plate for movement between a first position adjacent the mounting plate and a second position pivoted away from the mounting plate to facilitate access to both sides of the melter subassembly;

the melter subassembly further including at least one outlet receiving melted adhesive from the manifold; and a dispensing hose coupled with the at least one outlet and dispensing melted adhesive therethrough.

16. The apparatus of claim 15, further comprising:

a control subassembly coupled to the front side of the mounting plate and spaced apart from the melter subassembly;

the control subassembly including a controller in communication with the melter subassembly.

17. An apparatus for dispensing adhesive, comprising:

a melter subassembly comprising a hopper for receiving unmelted adhesive, a heater communicating with the hopper and melting adhesive received from the hopper, a reservoir communicating with the heater and receiving melted adhesive therefrom, and an adhesive manifold communicating with the reservoir;

the hopper, heater, and reservoir arranged in a vertically aligned configuration whereby adhesive is moved by gravity from the hopper, through the heater, to the reservoir; and at least one outlet couplable to a dispensing hose and receiving melted adhesive from the manifold for dispensing through the hose.

18. The apparatus of claim 17, further comprising a pump operably coupled with the adhesive manifold and pumping adhesive from the adhesive manifold through the at least one outlet for dispensing through the hose.

19. The apparatus of claim 18, wherein the pump is offset laterally from the vertically aligned hopper, heater, and reservoir.

20. The apparatus of claim 19, wherein the pump extends along a direction parallel to the vertically aligned hopper, heater, and reservoir.

21. The apparatus of claim 17, further comprising a cyclone in communication with the hopper and feeding solid adhesive to the hopper.

22. The apparatus of claim 17, further comprising:

a sensor associated with the hopper, the sensor sensing a level of adhesive material in the hopper; and a controller communicating with the melter subassembly and controlling operation thereof to dispense adhesive;

the controller receiving signals from the sensor related to the level of adhesive in the hopper.

23. The apparatus of claim 17, wherein a material handling volume of at least one of the hopper, heater, or reservoir is selected to minimize exposure of adhesive to heat from the melter subassembly.

24. The apparatus of claim 17, wherein the manifold includes a bottom surface opposite the vertically aligned hopper, heater, and reservoir;

the at least one outlet located on the bottom surface of the manifold.

25. The apparatus of claim 17, wherein the heater has a melting surface matched to the particular size of adhesive used.

26. A method of dispensing hot melt adhesive, the method comprising:

delivering unmelted adhesive through an inlet conduit into a cyclone using pressurized air;

receiving the unmelted adhesive into a hopper from the cyclone;

passing the unmelted adhesive by gravity feed from the hopper to a heater vertically aligned with the hopper;

melting the adhesive with the heater;

receiving the melted adhesive into a manifold; and pumping melted adhesive through a dispensing hose coupled with an outlet.

27. The method of claim 26, wherein pumping melted adhesive through a dispensing hose comprises pumping the melted adhesive through an outlet located at the bottom of the manifold.

28. The method of claim 26, further comprising:

sensing a level of adhesive in the hopper; and controlling the delivery of unmelted adhesive into the cyclone based on the sensed level of adhesive.

* * * * *